United States Patent [19]

Lawrence et al.

[11] 4,446,606

[45] May 8, 1984

[54] CONTINUOUS COMPRESSIVE PRESHRINKING AND DRYING METHOD

[75] Inventors: Jackson Lawrence, West Sand Lake; Harry A. Webb, Menands; John R. Frederick, Cohoes, all of N.Y.

[73] Assignee: Cluett, Peabody & Co., Inc., New York, N.Y.

[21] Appl. No.: 197,297

[22] Filed: Oct. 15, 1980

[51] Int. Cl.[3] ..... D06C 21/00

[52] U.S. Cl. ..... 26/18.6

[58] Field of Search ..... 26/18.6

[56] References Cited

U.S. PATENT DOCUMENTS

| | | | |
|---|---|---|---|
| 3,267,549 | 8/1966 | Rand | 26/18.6 X |
| 3,530,510 | 9/1970 | Rabold | 26/18.6 UX |
| 4,031,596 | 6/1977 | Joy | 26/18.6 |
| 4,051,215 | 9/1977 | Tsuruta et al. | 26/18.6 X |
| 4,156,955 | 6/1979 | Joy | 26/18.6 |

FOREIGN PATENT DOCUMENTS

| | | | |
|---|---|---|---|
| 46-25555 | 7/1971 | Japan | 26/18.6 |
| 50-13396 | 5/1975 | Japan | 26/18.6 |
| 53-10787 | 1/1978 | Japan | 26/18.6 |
| 2034781 | 6/1980 | United Kingdom | 26/18.6 |

*Primary Examiner*—Robert Mackey

*Attorney, Agent, or Firm*—James F. Bryan

[57] ABSTRACT

After compressive shrinking, moist (15% to 25% moisture by weight of fabric), preshrunk fabric is directed into a drum-type drier in which it is restrained while being dried to a moisture content of say 5% to 14%. Thereafter, the fabric is completely dried in a loop-type drier and additionally preshrunk while the fabric is in a relaxed state.

4 Claims, 3 Drawing Figures

CONTINUOUS COMPRESSIVE PRESHRINKING AND DRYING METHOD

BACKGROUND OF THE INVENTION

The present invention concerns a method for continuously preshrinking moist fabric, particularly knitted cellulosic fabric and for providing complete drying and improved dimensional stability of such fabric at high speeds with great uniformity. Conventionally, fabric which is to be compressively preshrunk by using various well-known mechanical preshrinking means, such as a rubber belt, is first moistened to have an absolute moisture content of say, 15% to 25% moisture by weight of fabric. After mechanical preshrinking, the fabric is dried in a Palmer or drum-type drier which causes the fabric to be restrained dimensionally between the heated drying drum and a felt blanket during the drying process. Inherently such driers impart a degree of one-sidedness to the fabric, that is to say, the fabric surface is rendered smoother on the side contacting the heated drum. This can be offset to some extent where a number of drums are used to achieve complete drying by causing opposite sides of the fabric successively to contact one or more of the heated drums.

In the arrangement just described, the speed at which the fabric will be dried is, generally speaking, a function of the initial moisture content of the fabric, the weight and composition of the fabric, and the number of drying drums used. In order to limit the capital investment, many smaller fabric manufacturers and finishers are forced to run their operation at a fairly slow speed in order not to exceed the drying capacity of the drying section. The present invention has primarily the purpose of utilizing a method of drying which permits the use of one heated drum in combination with a loop-type drier, the combination not only providing reduced capital investment, but greatly increased speed, while improving the uniformity of the fabric finish.

SUMMARY OF THE INVENTION

In accordance with the present invention, a method of continuous preshrinking and drying of cellulosic fabric has been devised comprising initial mechanical preshrinking of the fabric while the fabric has a moisture content of about 15% to 25%. After mechanical preshrinking to say, 12% to 16% (or other requirements of the fabric), the fabric is conveyed preferably about a single heated drier drum while it is restrained dimensionally widthwise and lengthwise and the moisture content of the fabric is reduced to about 5% to 14%. Thereafter, the fabric is conveyed to a loop-type drier wherein it is finally dried (to have no more than 4% moisture) while in a relaxed state, the initial 5% to 14% of moisture which the fabric contains as it enters the loop drier permitting the fabric to contract during this stage of drying to achieve an additional approximate 2% to 3% preshrinkage. In accordance with the invention, drying speeds are in the range of 25 to 45 yards per minute for 100% cellulosic fabric, while speeds of 40 to 70 yards per minute are common for fabric blends containing cellulosic fiber. With respect to 100% cellulosic pre-resin treated fabric and fiber blends containing cellulosic fiber, after the fabric is dried in the loop drier to have no more than 4% moisture, heat setting of the synthetic fiber and curing of the resin is achieved as a final step in the loop drier; however, prior to such heat setting or curing, the beneficial effects of the invention have already been achieved.

DESCRIPTION OF A PARTICULAR EMBODIMENT

Figure 1:
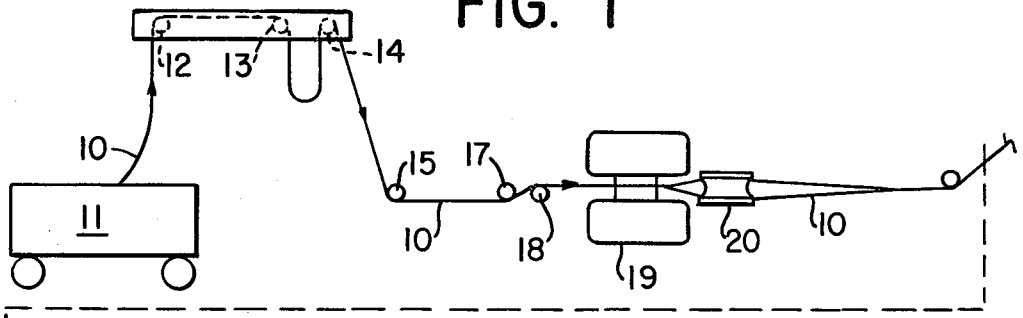
FIG. 1 illustrates diagrammatically a partial side elevation of a section of one form of apparatus suitable for practicing the invention.
Figure 2:
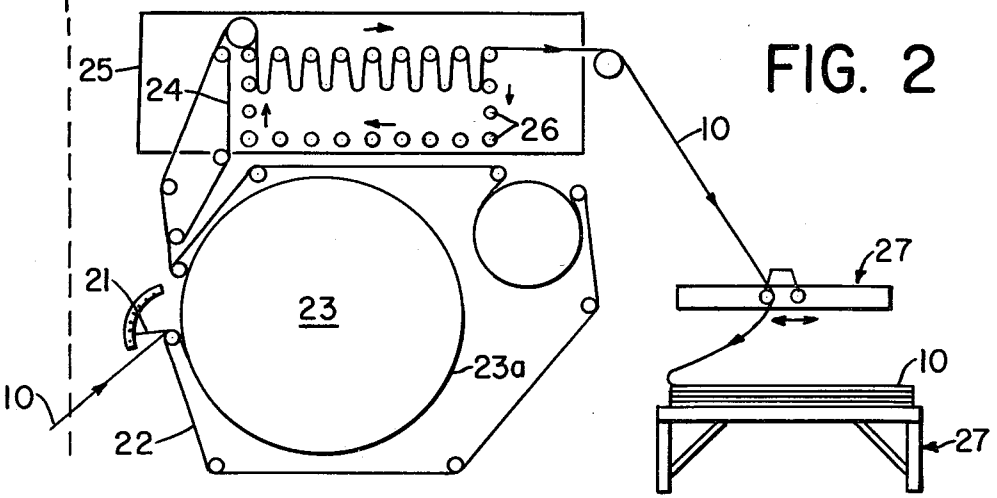
FIG. 2 is a continuation of FIG. 1.

Referring to the drawing in detail, it will be seen that a continuous web 10 of tubular knit textile fabric is fed from a truck 11 to skying rolls 12, 13 and 14 around an idler roll 15 to a pair of feed rolls 17 and 18 thence through a steam box 19 wherein a prescribed amount of moisture will be imparted to web 10 by spraying it with steam and/or water. The moisture content of the fabric after passing through the steam box 19 will be typically in the range of 15% to 25% by weight of fabric. Prior to being compressively shrunk, the web 10 then passes through a spreader 20 to adjust the width before being fed between a flexible shoe 21 and the blanket 22 of the heated drum felt belt compressive shrinker 23. This compressive shrinking arrangement has more particularly been shown in U.S. Pat. No. 4,156,955. It will be understood that a rubber belt compressive shrinking machine with or without a flexible shoe is considered an equivalent to the illustrated apparatus and that the degree of shrinkage imparted will depend upon the requirements of the fabric (that is, will be generally sufficient to inhibit or prevent shrinkage during subsequent washing). Preshrinkage may therefore be 12% or some lower or higher amount according to the needs of the fabric.

During its passage about heated drum **23*a*, the fabric will be dimensionally restrained as is usual in such driers. That is to say, the fabric will be held against the heated drum 23*a* by the blanket 22 so that any tendency for the fabric to shrink laterally or longitudinally is more or less prevented. In accordance with the present invention, fabric will not be dried completely by the heated drum 23*a*, but rather to a point where the fabric has sufficient dimensional integrity to be handled without loss of the previous preshrinkage imparted to the fabric by the compressive shrinker. In other words, fabric will be dried to an extent where without further dimensional restraint, additional drying of the fabric can be achieved without loss of preshrinkage previously imparted to the fabric by the compressive shrinker 23**. However, as a further aspect of the invention, additional preshrinkage is obtained in the final drying of the fabric, and this additional shrinkage is made possible by having sufficient moisture remain in the fabric prior to final drying of the fabric. In accordance with the invention, to achieve these objectives, the fabric should be partially dried to have about 5% to 14% moisture by weight of fabric.

In accordance with the invention, to complete the drying process, fabric having a moisture content of about 5% to 14% is conveyed from the drum **23*a* by belt 24 into a loop-type drier 25. The poles 23 therein are driven by a differential drive, and conveyor belt 24 is driven by another differential drive so that by varying the speeds of the two drives, loop lengths of the web 10 between poles 26 can be increased or decreased. This control permits increasing or decreasing the drying time of the fabric in the drier 25 with respect to the drying time of the fabric about heated drum 23***a*. Examples of this will be given subsequently. A most important aspect in the use of the drier 25 is to provide relatively tensionless handling of the fabric throughout the final drying process in order to prevent pulling out of the shrinkage previously imparted. Furthermore, since the fabric is not completely dry when it passes into the drier 25, additional shrinkage of about 2% to 3% is achieved during the final drying process. This is made possible because the fabric has only been partially dried, and this additional moisture provides lubrication during the final drying process permitting contracting movement of the fibers. If the moisture content of the fabric entering drier 25 were say, 3% to 4%, which is the amount of moisture generally associated with a completely dried fabric, minimal or no contraction of the fibers would occur.

The use of the loop drier 25 also effects improvement in the finish imparted by the drum 23*a*. Since, in accordance with the invention, only a single drum is used, inherently the fabric will have some one-sidedness because only a single side of the fabric will be pressed against the single heated drum. Because the fabric does retain significant amounts of moisture as it enters the loop drier 25, such moisture will tend to migrate toward the relatively drier surface which previously had been pressed against the drum 23*a* and since both sides of the fabric are exposed to the drying atmosphere in the loop drier, much of the one-sidedness is eliminated. Again, this effect would not be possible if the fabric had been dried say to a level of 3% to 4% prior to entering the loop drier.

Although the application of the present invention is with respect to its effect on cellulosic fabrics or blends of fibers which include significant amounts of cellulosic fibers, the invention operates in the same manner whether or not the cellulosic fabric has been pretreated with a finishing resin. In other words, the application of the invention is not affected by the fact that a cellulosic fabric may have been treated with a resin prior to compressive shrinking, partial drying in a Palmer and final drying in a loop drier. Where a resin treatment has been given to the cellulosic fabric, obviously the loop drier can be used to effect curing of the resin, but since such curing will not begin until the fabric is dried to a low level of moisture content (i.e. no more than 4%), the other effects of the invention will already have been achieved prior to curing of the resin. In other words, by carefully controlling the moisture content of the partially dried fabric, the fabric is rendered dimensionally stable in the Palmer to a point where subsequent tensionless drying in the loop drier will not destroy or remove the shrinkage previously imparted. Furthermore, the moisture content of the fabric entering the loop drier is sufficient to permit additional contraction or shrinkage of the fabric of about 2% to 3%. It is at this point that the resin can begin to be cured since sufficient moisture will have been driven from the fabric to permit raising the temperature of the fabric to say 280° F. to 340° F., the normal curing temperature.

In addition to the above described advantages, as mentioned previously, the inventive concept and combination permits high speed drying of fabric with a minimum of equipment. By way of examples, drying speeds of 25 to 45 yards per minute are quite usual for drying 100% cellulosic fabric, while speeds of 40 to 70 yards per minute are more common for fabric blends containing cellulosic fiber. Reference herein to the moisture content in a fabric refers to either 100% cellulosic fabric or to the cellulosic portion thereof. In other words, in a 50/50 polyester-cotton blend, the moisture content (if any) of the polyester portion is ignored and the fabric would be dried about a heated drum to 5% to 14% moisture content of the cotton portion.

In respect to blends, a fabric will be heat set in the loop drier subsequent to reduction of its cellulosic fiber moisture content to at least 4% as was the case with respect to resin treated cotton. Drying speeds of the latter are in the order of 40 to 70 yards per minute. It should be mentioned that the residence time of the fabric in the loop drier generally will be 3 to 8 times as great as the drying time in the Palmer. For example, at a speed of 30 yards per minute overall, the residence time of the fabric about drum 23*a* may be only 16 seconds, whereas the fabric will have a total residence time in the loop drier of 120 seconds.

Figure 3:
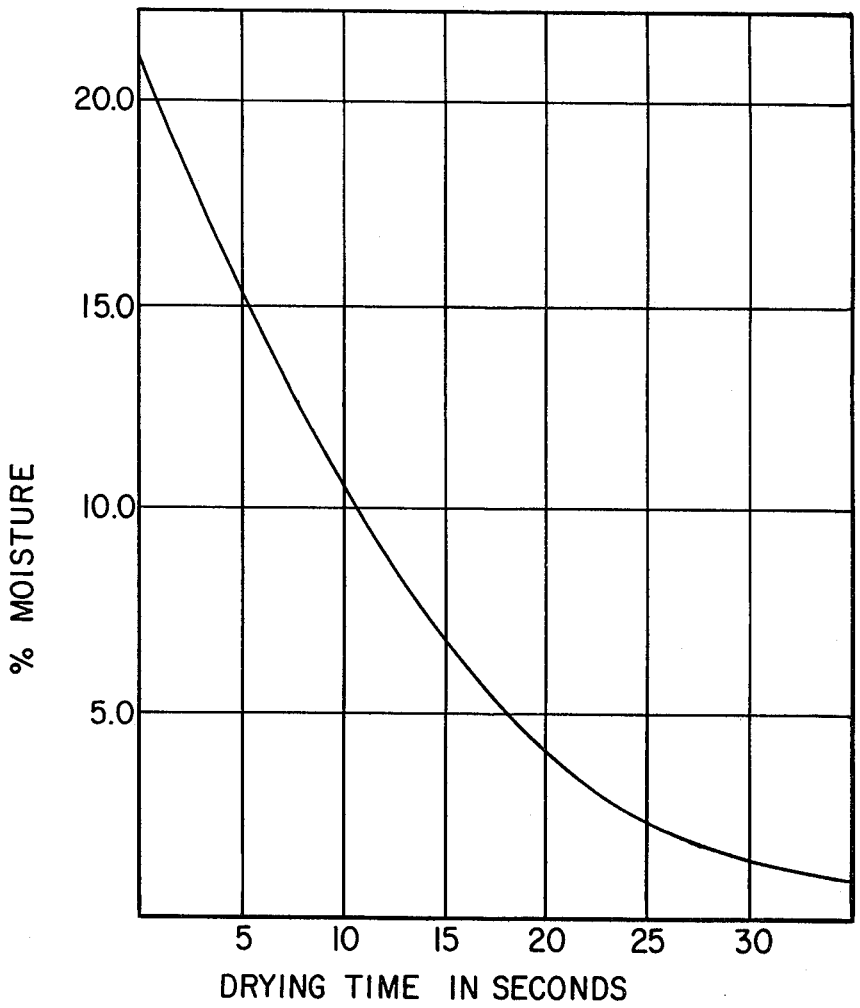
FIG. 3 is a graph illustrating a typical drying cycle in conventional drum-type apparatus.

One reason why the Palmer, loop drier combination of the present invention permits great flexibility and high speed drying can be seen with reference to FIG. 3 which is a graph indicating percent of fabric moisture against drying time using a drum-type drier. This graph which is typical of drying curves for most fabrics indicates that to dry a fabric from a moisture level of say, 20% to 8% takes about 12 seconds, and to remove additional moisture to say, 3% would take an additional 10 seconds. Applying this principle, a single heated drum can be used at high speed to effectively remove moisture down to the relatively low level of 5% to 14% required by the invention, and a loop drier with the capability of longer residence times can be used to remove the remaining moisture, while obtaining the additional benefits previously described.

It will be understood that the above description of an application of the present invention is merely representative. In order to appreciate more fully the scope of the invention, reference should be made to the appended claims.

We claim:

1. A method of continuous preshrinking and drying of cellulosic fabric with reduced one-sidedness comprising (a) mechanically preshrinking cellulosic fabric having an initial moisture content of about 15% to 25%, (b) conveying said fabric after preshrinking about a heated drier drum while restraining said fabric dimensionally widthwise and lengthwise, (c) while thus conveying and restraining said fabric, controllably reducing the moisture content of said fabric to a residual amount of about 5% to 14%, (d) the upper limit of said residual amount providing sufficient dimensional integrity to enable the fabric to be further handled without significant loss of preshrinkage previously imparted, (e) the lower limit of said residual amount being such as to assure, upon removal of the fabric from said drum, sufficient moisture to enable additional shrinkage of the fabric to occur and to provide greater uniformity in the fabric by accommodating migration of residual moisture within the fabric from one side toward the other, (f) immediately thereafter conveying said fabric in a tensionless manner into a loop drier wherein said fabric is arranged in tension-free loops about the poles of said drier, (g) conveying said fabric through said loop drier in an essentially relaxed state while further controllably reducing said moisture content to at least 4%, (h) said fabric being permitted to contract and thereby being further preshrunk lengthwise in said loop drier by reason of said further controlled reduction of moisture by said loop drier, and (i) thereafter removing said fabric from said loop drier.

2. The method according to claim 1 wherein said fabric is initially dried to have a moisture content of about 5% to 14% while being conveyed about a single heated drier drum.

3. The method according to claim 1 wherein said fabric is further preshrunk in said loop drier about 2% to 3% in length by reason of the further controlled reduction of moisture by said loop drier.

4. The method according to claim 1 in which said fabric is a composite of cellulosic fiber and synthetic fiber and wherein the moisture content of the cellulosic portion thereof is reduced during passage about the heated drum to about 5% to 14% and thereafter is further reduced in said loop drier to at least 4%.

* * * * *